United States Patent [19]

Moran et al.

[11] Patent Number: 4,736,474

[45] Date of Patent: Apr. 12, 1988

[54] RESCUE TRANSPORTATION DEVICE

[75] Inventors: Harold Moran; Gregory Switlik, both of Trenton; Stanley Switlik, Pennington; Richard Switlik, Jr., Bay Head; Gustavo Fanjul, Stockton, all of N.J.

[73] Assignee: Switlik Parachute Company, Inc., Trenton, N.J.

[21] Appl. No.: 44,621

[22] Filed: May 1, 1987

[51] Int. Cl.[4] ..... A61G 7/08

[52] U.S. Cl. ..... 5/82 R; 5/89; 5/449

[58] Field of Search ..... 5/82 R, 89, 420, 449, 5/453, 454; 128/87 R, 134; 224/158; 280/19, 20; 441/66, 90

[56] References Cited

U.S. PATENT DOCUMENTS

| | | | |
|---|---|---|---|
| 3,775,782 | 12/1973 | Rice et al. | 5/82 R |
| 4,024,861 | 5/1977 | Vincent | 5/82 R X |
| 4,442,838 | 4/1984 | Samson et al. | 5/453 X |
| 4,621,382 | 11/1986 | Burriss et al. | 5/82 R |

FOREIGN PATENT DOCUMENTS

| | | | |
|---|---|---|---|
| 148718 | 6/1981 | German Democratic Rep. | 5/82 R |

*Primary Examiner*—Michael F. Trettel

*Attorney, Agent, or Firm*—Sperry, Zoda & Kane

[57] ABSTRACT

A rescue transportation device having an inflatable support member with a generally horizontally extending main section and an inclined section adjacent to one end of the main section extending upwardly and outwardly therefrom. A cover is adapted to extend about the inflatable support member and is capable of placement on and off the inflatable support member by way of a slot means defined therein to facilitate fitting. A wide open mesh head restraint device is selectively attachable with respect to the cover to receive a user's head and hold it fixedly with respect to the main support member. A lower body restraint device is also attachable with respect to the cover and is adapted to receive and selectively hold the user's lower body with respect to the inflatable support member. Two restraint attachment devices are fixedly secured to the cover and are adapted to receive the head restraint or the lower body adjacent to the inclined section and in the other orientation the head of the user will be at the opposite end of the inflated support member from the inclined section thereof. Towing securement means may be defined on the cover adjacent the inclined section or adjacent the opposite section thereof. An inflating device such as a gas cannister or other mechanical device such as a pump may be attached with respect to the cover to facilitate inflation of the support member in the field. The cover member may be of two or three additional thicknesses along the bottom section thereof to prevent damage to the support member during dragging thereof. The head restraint preferably includes two inflatable cushions spatially disposed with respect to one another to receive a user's head therebetween. This distance can be varied in order to compensate for various sizes in the head of a user or for a helmeted head where removal of the helmet might further aggravate the injuries of the user. Furthermore, the head retaining means includes a wide netting being laterally securable between the inflatable cushions to facilitate fixed securement of the head of the user with respect to the inflatable member.

26 Claims, 1 Drawing Sheet

RESCUE TRANSPORTATION DEVICE

BACKGROUND OF THE INVENTION

1. Field of the Invention

The present invention deals with the field of devices which are collapsible and are capable of usage in remote locations to remove disabled users. This may be useful for removal of individuals from remote locations such as resulting from hunting accidents, skiing accidents or airplane accidents, and the like.

It is desirable that the entire device be collapsible such as to be easily carried by rescue personnel. It is also desirable that the device be quickly rendered into a completely useful orientation such as to be able to be carried like a litter, dragged along the surface, floated in water or lifted by a helicopter. Such devices should preferably be capable of being dragged through thick brush as well as being dragged upon snow, ice, dirt, leaves and other possible ground conditions. Also, such devices should be capable of flotation during transport.

The transportation of the device of the present invention is particularly capable of storage in small compartments such as car trunks, aircraft compartments or other locations where a normal fixed litter could not reasonably be stored. Also the present invention is particularly usable since it is capable of being inflated under water beneath a person who is injured and floating prone upon the water to thereby provide some element of back protection. Also while water borne the device of the present invention can be paddled to facilitate water rescue efforts.

2. Description of the Prior Art

Example of prior art devices utilizing multi-purpose rescue transport devices are shown in U.S. Pat. Nos. Des. 206,335 issued to V. M. Solipasso et al; 4,442,557 issued to R. M. Clemens; 4,389,961 issued to J. R. Parish; 4,335,891 issued to F. P. Alley et al; 4,283,068 issued to S.A. Keyser; U.S. Pat. No. 4,046,393 issued to K. Vadnais; 3,432,182 issued to V. M. Solipasso; 3,319,972 issued to F. R. Gallaher; 3,222,080 issued to W. T. R. Kinraide; 2,986,751 issued to L. Baren; 2,064,128 issued to E. E. Smithers et al; 2,018,548 issued to W. T. Currey and 1,206,696 issued to M. A. Gulbrandsen.

SUMMARY OF THE INVENTION

The present invention provides a rescue transportation device having an inflatable horizontally extending support member defining a first support end and a second support end thereon. An inclined section inflatable with the support member is positioned adjacent to the first support end of the main section such as to extend upwardly and outwardly therefrom. A cover is adapted to extend about the vertical support member. The cover defines a slot therein to facilitate removal and placement of the cover in the encapsulating position about the inflatable support member. The cover defines a first cover end adjacent the first support end and a second cover end adjacent the second support end.

A head restraint means of a wide open mesh configuration is attachable with respect to the cover and is adapted to receive a user's head for support thereof with respect to the inflatable support member. Also a lower body restraint means is attachable with respect to the cover to receive and retain a user's lower body with respect to the support member. A first restraint attachment means is secured to the cover adjacent the first cover end thereof and is adapted to receive secured thereto either the head restraint means or the lower body restraint means. A second restraint attachment means is secured to the cover adjacent the second cover end and is adapted to receive and selectively secure either the head restraint means or the lower body restraint means with respect to the cover. Thus with this configuration the head restraint means may be secured adjacent to the inclined section and the lower body restraint may be secured at the opposite end from the inclined section, or alternatively, the lower body restraint means can be secured adjacent to the inclined section and the head restraint means can be secured at the opposite end of the support member from the inclined section. In this manner, when dragging of the rescue transportation device of the present invention the head or feet of the user can be oriented in the forwardly extending direction.

A towing securement means may be fixedly secured to the cover means such as to be adapted to receive a towing line secured thereto to facilitate dragging of the rescue transportation device. Furthermore, the towing securement means can be secured to the cover means adjacent the first cover and/or adjacent the second cover and for this purpose a towing attachment means is secured in both locations to allow either possible manner of usage.

The device may further include an inflation means detachably securable with respect to the cover for mounting thereof. Also an inflation attachment means may be fixedly secured to the cover such as to detachably secure the inflation means thereto. To further enhance secure holding of the user with respect to the support member, a central body restraint means may be secured to the cover means between the first and second restraint attachment means to restrain the central body area of the user with respect to the inflatable support member. Upon inflation of the inflatable support member of the present invention and the resulting inflation of the inclined section and the horizontally extending support section, the overall final constructure of the rescue transportation device is itself capable of flotation to facilitate rescue in water areas. Furthermore the device may include air lifting straps extending across the bottom surface thereof and being attachable with respect to a helicopter to facilitate remote area rescue extraction.

In order to enhance protection of the inflation support member, the cover means may include a lower surface having double thickness or more extending across the entire lower surface of the main section and of the inclined section. To further add protection, the cover means may include a multiple reinforced section on the lower edge of the cover means adjacent the intersection between the inclined section and the main section where significant "plowing" will be experienced when dragging with the inclined section in the leading orientation.

In addition to dragging the rescue transportation device of the present invention, it can be usable carried as a litter and for this purpose litter handles may be secured along the upper surfaces of the cover to facilitate carrying from the opposite sides by rescue personnel.

A blanket means which may be collapsible or rollable is selectively securable with respect to the cover means adjacent the head or feet of a user to facilitate treatment of the user. Also to enhance speed of treatment, the straps utilized in the head restraint means, the lower body restraint means and the central body restraint means may include plastic buckles to facilitate X-raying of a user while still retained in place on the rescue transportation device.

The head restraint means of the present invention may include a first inflatable cushion means as well as a second inflatable cushion means spatially disposed laterally from the first inflatable cushion means and adapted to receive the user's head therebetween for support and restraint thereof. These inflatable cushions should be adjustable laterally with respect to one another to be capable of receiving various sizes of heads as well as a helmeted head therebetween. An adjustable head retaining strap means of an open mesh material may be also included securable with respect to the first inflatable cushion and the second inflatable cushion to facilitate support and restraint of a user's head therebetween. Preferably the first inflatable cushion and the second inflatable cushion will be manually inflatable.

The inflatable support member may include an inflating valve preferably positioned adjacent the inclined section such that the inflation means can be connected thereto to facilitate inflation of the entire support member. This inflation valve can be a one-way pneumatic valve or other mechanical means such as a pump. Access to this valve may be achieved by said cover means defining an access flat means adjacent thereto.

A gusset means may be secured to the cover means adjacent to the inner section between the inclined section and the main section to facilitate holding of the inclined section in the inclined orientation extending upwardly and outwardly with respect to the main section and to provide some element of protection of a user during dragging of the rescue transportation device.

To facilitate ease of attachment or removal of the head restraint means or the lower body restraint means with respect to the first and second restraint attachment means, hook and loop type attachment devices sold under the trademark Velcro can be utilized. Also to facilitate dragging of the rescue transportation device through areas of heavy brush, the material chosen for the cover means may have a low coefficient of friction to ease towing or dragging thereof.

It is an object of the present invention to provide a rescue transportation device wherein a completely collapsible rescue litter is utilized.

It is an object of the present invention to provide a rescue transportation device wherein upon inflation the support member for the disabled user can be dragged or towed in the feet first or head first orientation.

It is an object of the present invention to provide a rescue transportation device wherein an inclined section is included extending upwardly and outwardly from one edge of the support member to provide an element of "plowing" when dragged through tall grass or heavy underbrush or over similar terrain.

It is an object of the present invention to provide a rescue transportation device wherein the inflatable members are deployed quickly.

It is an object of the present invention to provide a rescue transportation device wherein a head restraint means is included having two opposite cushions for gently but firmly retaining the head of a user with respect to the support surface.

It is an object of the present invention to provide a rescue transportation device wherein a head restraint means is used in combination with a lower body restraint means and a central body restraint means to facilitate securement of a disabled user with respect to the transporting support member.

It is an object of the present invention to provide a rescue transportation device wherein floatation is possible even after securement of the disabled user with respect to the transportation device.

It is an object of the present invention to provide a rescue transportation device wherein a cover means is separately configured and is adapted to be placed about an encapsulate the support member to facilitate the attachment of various rescue attachment or other devices with respect to the support platform.

It is an object of the present invention to provide a rescue transportation device wherein a cover means is included of several thicknesses of material below the support member to facilitate movement and minimize damaging of the lower surface of the support member as it is dragged or towed over the surrounding terrain.

It is an object of the present invention to provide a rescue transportation device wherein plastic buckling means are included to allow clean X-rays to be taken of a disabled user while still strapped within the rescue transportation device.

It is an object of the present invention to provide a rescue transportation device wherein one single device can be used both as a litter and as a dragging sled.

It is an object of the present invention to provide a rescue transportation device wherein the support member can be used over and over again and the only part that need be replaced or maintained is the cover means which carries the external attachments thereto.

It is an object of the present invention to provide a rescue transportation device which is capable of storage in small compartments such as in cars, rescue vehicles and airplanes.

It is an object of the present invention to provide a rescue transportation device which includes airlifting means to facilitate extraction from remote locations by helicopter rescue.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
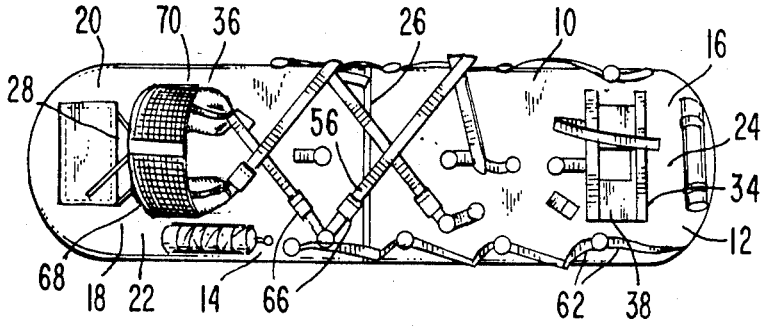
FIG. 1 is a top plan view of an embodiment of the rescue transportation device of the present invention.
Figure 2:
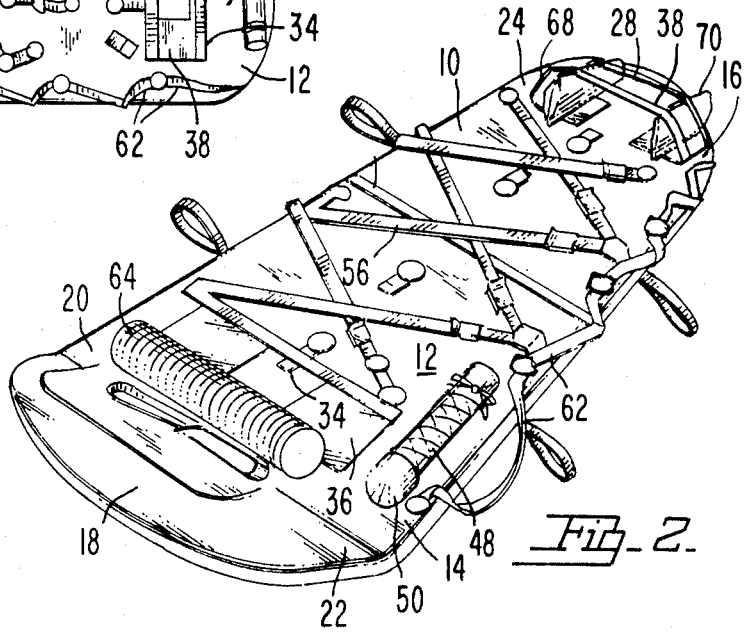
FIG. 2 is a perspective view of an embodiment of the rescue transportation device as shown in FIG. 1 with the head restraint means shown attached to the opposite end from the showing in FIG. 1.

The present invention provides an inflatable support member 10 including a main section 12 and an inclined section 18. The main section extends generally horizontally and the inclined section 18 extends upwardly and outwardly with respect to the first support end 14 of main section 12. Second support end 16 is located opposite with respect to first support end 14 of main section 12.

A cover means 20 is positioned extending about the main section 12 and the inclined section 18 with the first cover end 22 thereof positioned adjacent to the first support end 14 and the second cover end 24 thereof positioned adjacent to the second support end 16. Placement of the cover means 20 extending about the inflatable support member 10 is facilitated by a slot means 26 defined therein. By placement of the inflatable support member 10 through the slot means 26, the inflatable support member 10 can be completely encapsulated by cover means 20 when inflated.

The cover means 20 can then have secured thereto various pieces of rescue and restraint apparatus usable in remote locations for rescue operations. For example, a head restraint means 28 of an open mesh configuration may be adapted to hold the head 32 of user 30 in gentle yet fixed orientation with respect to the inflated main section 12. Also, a lower body restraint means 34 may be secured with respect to the main section 12 in such a manner as to be adapted to extend about the legs of a user 30 for fixed securement thereof with respect to main section 12.

A first restraint attachment means which may be a Velcro attachment means 36 is mounted preferably on cover means 20. Also a second restraint attachment means which may be a Velcro attachment means 38 is secured with respect to the cover means 20. First restraint attachment means 36 is secured adjacent said first cover end 22 and second restraint attachment means 38 is secured adjacent second cover end 24.

With this configuration, the head restraint means 28 may be secured to first attachment means 36 or second attachment means 38. When head restraint means 28 is secured to the first restraint attachment means 36 the head of the user will be located adjacent to the inclined section 18. When the head restraint means 28 is secured to the second restraint attachment means 38, the feet of the user will be positioned adjacent to the inclined section 18. In either case, the lower body restraint means 38 will be secured to the opposite restraint attachment means 36 or 38 to facilitate firm attachment of the entire body of the user 30 with respect to the inflatable support member 10.

The head restraint means 28 of the present invention may be made of an open mesh configuration 29 to facilitate comfort of the user. Such an open mesh configuration would prevent sliding of the head restraining means along the body and also would allow the user to breath therethrough. With certain open mesh configurations it is also possible that a restrained person would be able to have some element of sight through the mesh itself further facilitating comfort.

To facilitate movement of the rescue transportation device of the present invention, a towing securement means 40 may be secured to the cover means 28 preferably on the lower surface thereof. For this purpose a first towing attachment means 44 may be secured adjacent to the first cover end 22 and a second towing attachment means 46 may be secured adjacent to the second cover end 24. Thus the towing line 42 may be secured to the first towing attachment means 44 to drag the inflatable support member 30 in such a manner that the inclined section 18 is the leading edge. Alternatively, if the towing securement means 40 is secured with respect to the second towing attachment means 46, the inflatable support member 10 will be dragged with the second support end 16 of main section 12 in the leading position.

Normally, when dragging over ice or very flat surfaces, it would be desirable that the first support end 14 of main section 12 be the leading edge of the dragged inflatable support member 10. Alternatively, when dragging through heavy underbrush, high grasses or similar terrain, it may be preferable to utilize the inclined section 18 extending in the forward direction to "plow" through the restricting terrain. This orientation can be achieved by securing of the towing line 42 with respect to the first towing attachment means 44.

The rescue transportation device of the present invention also may include air rescue straps 79 which are capable of being secured with respect to a helicopter for facilitating rescue from remote locations such as mountainsides or the like.

It is anticipated that the present invention will be carried by rescue personnel to remote locations in a collapsed orientation. Thus it will be necessary to include an inflation means 48 such as a gas cannister or air pump secured to the cover means 20 by an inflation attachment means 50. An inflation valve means 52 may be defined in fluid flow communication with the interior of the inflatable support member 10 such that connection of the inflation means 48 with respect to inflation valve means 52 will cause rapid deployment of the rescue transportation device of the present invention. Preferably a removable access flap means 54 may be defined in the cover means 20 to facilitate access to the inflation valve means 52.

A central body restraint means 56 may be positioned between the lower body restraint means 34 and the head restraint means 28 in order to secure the central or torso area of a user if required.

A particular advantage of the construction of the present invention is the capability of multiple usages of the inflatable support member 10 since no damaging thereof will be encountered due to that member being encapsulated by the cover means 20. Also multiple cover means 20 can be used with a single inflatable support member 10 or in the alternative a multiple inflatable support members 10 can be usable with a single cover means 20. That is, deterioration of one part will not prevent re-use of the other part thereof. Cover means 20 will take most of the damage and once deteriorated significantly, the cover means 20 will be replaced by a new cover means therefore virtually eliminating any possible damaging of the inflatable support member 10. To further minimize the possibility of damage, the cover means may include a double thickness 58 extending across the entire lower surface thereof since it is this surface which will basically contact the ground continuously during dragging. To further enhance protection of the cover, a multiple thickness 60 may be included on the lower surface thereof adjacent the intersection between the inclined member and the horizontal support member since the angle of intersection of these two members will be exposed to a significant amount of friction and damage.

The present invention is particularly useful since it is capable of dual usages both in the dragging and in the carrying orientation. When carried the present invention will utilize litter handle means 62 to facilitate carrying by an individual on each opposite side of the horizontal support means.

The present invention also anticipates a blanket means 64 being capable of attachment with respect to the cover means adjacent the head or the feet of the user to facilitate deployment thereof for keeping of the disabled user warm. Furthermore, plastic buckles 66 are anticipated to be used in association with each of the lower body restraint means 34, the central body restraint means 56 and the head restraint means 28. In this manner, X-rays of an individual can be made immediately upon arriving at a health care facility rather than waiting for removal of the user from the litter.

The head restraint means 28 of the present invention may include a first inflatable cushion means 68 and a second inflatable cushion means 70. Preferably these cushion means 68 and 70 will be laterally spaced with respect to one another to define therebetween an opening for receiving of the head of the disabled user. A head retaining strap means 72 of open mesh or net material will be secured with respect to the first cushion means 68 and the second cushion means 70 to firmly secure the user's head in a gentle meanner with respect to the main section 12 of inflatable support member 10. The positioning of the cushion means 68 and 70 with respect to one another will preferably be variable in order to accommodate users with different sized heads and to accommodate a user with a helmet still in place about the head.

Figure 3:
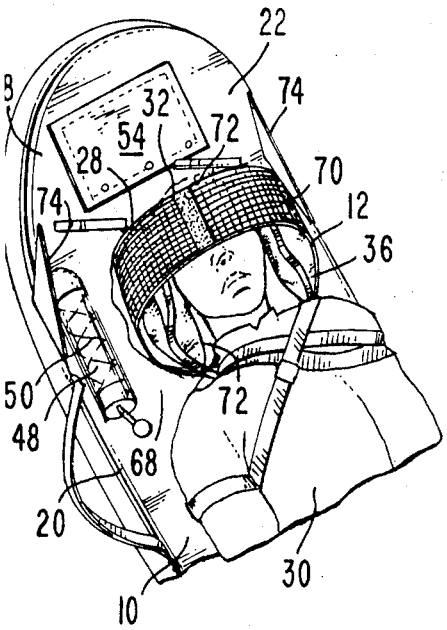
FIG. 3 is a perspective view of the embodiment of the rescue transportation device shown in FIG. 1 illustrating a disabled user in position within the head restraint means.
Figure 4:
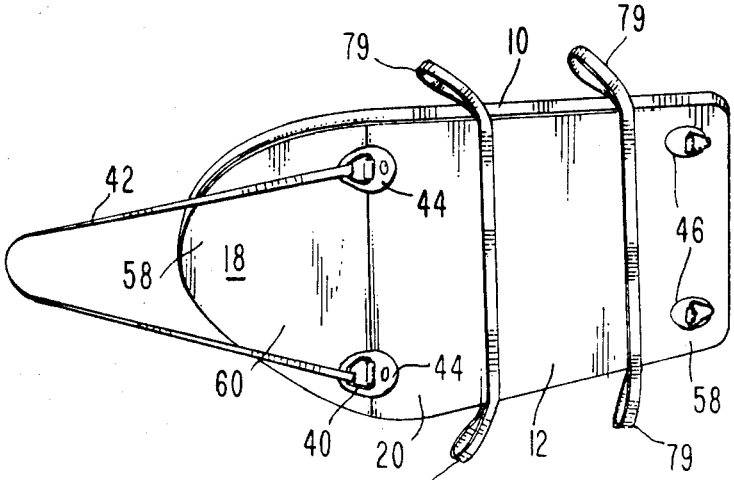
FIG. 4 is a bottom plan view of the embodiment of the rescue transportation device shown in FIG. 1.
Figure 5:
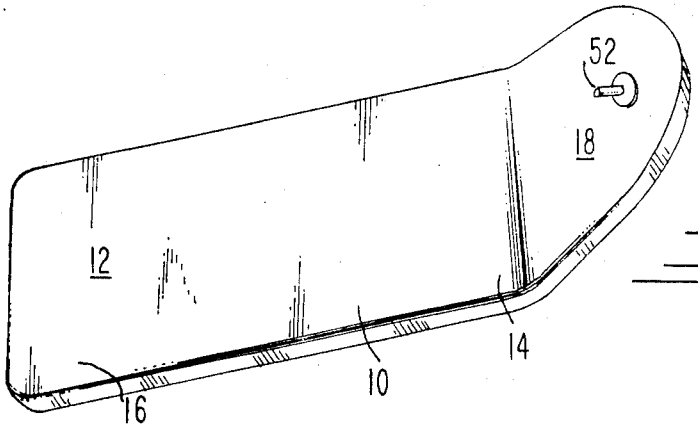
FIG. 5 is a perspective illustration of an embodiment of the inflatable support member of the present invention without the cover being secured thereabout.

A gusset means 74 may be included on the cover means 20. Such gusset means comprises a section of material extending from the portion of the cover means 20 encapsulating the inclined section 18 to the portion of the cover means 20 encapsulating the main section 12. This angular piece of material as best shown in FIG. 3 achieves a dual purpose. Firstly, the gusset means 74 will provide some element of protection to the user from twigs, grass, shrubs, or other elements of the terrain which may scratch or contact the face or other portions of the body of the user. Secondly, gusset means 74 will provide an increased element of stability to the inclined section 18 to maintain it in an upwardly and outwardly extending orientation with respect to the main section 12.

Thusly, in operation the present invention provides a rescue transportation device which is capable of being dragged, paddled, lifted or carried and thus has the combination usage as a litter or rescue sled as well as being capable of flotation to facilitate rescue adjacent water area. Furthermore, the encapsulating of the main support member with a cover means allows repeated reusage of the main structural support member repeatedly since only the cover must be replaced after usages.

While the inflation cushions 68 and 70 of the head restraint means 28 may be capable of inflation by inflation means 48, it may be preferable to allow for manual inflation thereof. This capability allows for fine adjustments to the lateral dimensions by over or under inflating of the cushions to facilitate a further element of control or variability to the amount of support given to the head of the user which can be very critical for disabled users having head injuries.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A rescue transportation device comprising:

(a) an inflatable support member including:

(1) a main section extending generally horizontally and being selectively inflatable, said main section defining a first support end and a second support end thereon; and (2) an inclined section being inflatable with said main section and being adjacent to said first support end of said main section and extending upwardly and outwardly therefrom;

(b) a cover means adapted to extend about said inflatable support member, said cover means defining a first cover end adjacent said first support end and a second cover end adjacent said second support end, said cover means defining a slot means therein adapted to allow removal and replacement thereof in position extending about said inflatable support member;

(c) a head restraint means attachable with respect to said cover means and being adapted to receive and selectively restrain a user's head with respect to said inflatable support member;

(d) a lower body restraint means attachable with respect to said cover means and being adapted to receive and selectively restrain a user's lower body with respect to said inflatable support member;

(e) a first restraint attachment means secured to said cover means adjacent said first cover end thereof and adapted to receive and selectively secure one of said head restraint means and said lower body restraint means with respect to said cover means adjacent said first cover end thereof;

(f) a second restraint attachment means secured to said cover means adjacent said second cover end thereof and adapted to receive and selectively secure one of said head restraint means and said lower body restraint means with respect to said cover means adjacent said second cover end thereof; and (g) a towing securement means fixedly mounted to said cover means and adapted to detachably secure a towing line therein to facilitate dragging of the rescue transportation device.

2. The rescue transportation device as defined in claim 1 wherein said head restraint means is of an open net material and is secured with respect to said first restraint attachment means and said lower body restraint means is secured with respect to said second restraint attachment means.

3. The rescue transportation device as defined in claim 1 wherein said lower body restraint means is secured with respect to said first restraint attachment means and said head restraint means is secured with respect to said second restraint attachment means.

4. The rescue transportation device as defined in claim 1 further comprising:

(a) inflation means detachably securable with respect to said cover means for mounting thereof; and (b) inflation attachment means fixedly secured with respect to said cover means and adapted to detachably secure said inflation means thereto.

5. The rescue transportation device as defined in claim 1 wherein said main section and said inclined section are in fluid flow communication with respect to one another to be simultaneously inflatable.

6. The rescue transportation device as defined in claim 1 further comprising a central body restraint means secured to said cover means and adapted to restrain the central body area of a user with respect to said inflatable support member.

7. The rescue transportation device as defined in claim 1 wherein said towing securement means includes a first towing attachment means located adjacent to said first cover end to facilitate dragging of said inflatable support member with said inclined section facing in a forward direction.

8. The rescue transportation device as defined in claim 1 wherein said towing securement means includes a second towing attachment means located adjacent to said second cover end to facilitate dragging of said inflatable support member with said inclined section facing in a rearward direction.

9. The rescue transportation device as defined in claim 1 further comprising a tow line means being selectively attachable with respect to said towing securement means.

10. The rescue transportation device as defined in claim 1 wherein said cover means includes a lower surface of multiple thickness extending across an entire lower surface of said main section and said inclined section.

11. The rescue transportation device as defined in claim 1 wherein said cover means includes a multiple reinforced section on a lower surface of said cover means adjacent the intersection between said inclined section and said main section.

12. The rescue transportation device as defined in claim 1 further comprising litter handle means secured along a pair of upper sides of said cover means to facilitate carrying of the rescue transportation device.

13. The rescue transportation device as defined in claim 1 further comprising a blanket means selectively securable with respect to said cover means.

14. The rescue transportation device as defined in claim 1 wherein said blanket means is selectively securable with respect to said cover means adjacent said first cover end and adjacent said second cover end.

15. The rescue transportation device as defined in claim 1 wherein said head restraint means and said lower body restraint means include plastic buckling means to facilitate X-raying of a user while retained in place on the rescue transportation device.

16. The rescue transportation device as defined in claim 1 wherein said head restraint means comprises:

(a) a first inflatable cushion means;

(b) a second inflatable cushion means spatially disposed laterally from said first inflatable cushion means and adapted to receive a user's head therebetween for support and restraint thereof; and (c) an adjustable head retaining strap means securable with respect to said first inflatable cushion and said second inflatable cushion to facilitate support and restraint of a user's head therebetween.

17. The rescue transportation device as defined in claim 16 wherein said first inflatable cushion means and said second inflatable cushion means are manually inflatable.

18. The rescue transportation device as defined in claim 16 wherein said first and second inflatable cushion means are movably adjustable laterally to vary the spatial separation therebetween to facilitate usage of the rescue transportation device with variously sized heads of users as well as allowing use with a user's helmet.

19. The rescue transportation device as defined in claim 1 wherein said inflatable support member includes an inflating valve.

20. The rescue transportation device as defined in claim 19 wherein said cover means includes a removable access flap to facilitate access to said inflating valve.

21. The rescue transportation device as defined in claim 1 further including gusset means secured to said cover means adjacent said inclined section and adjacent said main section to facilitate maintaining of said inclined section in a position extending upwardly and outwardly with respect to said main section and to provide protection to a user during dragging thereof.

22. The rescue transportation device as defined in claim 1 wherein said first restraint attachment means comprises a hook and loop type attachment device.

23. The rescue transportation device as defined in claim 1 wherein said second restraint attachment means comprises a hook and loop type attachment device.

24. The rescue transportation device as defined in claim 1 wherein said cover means is of a material with a low coefficient of friction to facilitate towing thereof over various surfaces.

25. The rescue transportation device as defined in claim 1 further including air rescue straps secured to the lower surface of said cover means and adapted to be detachably secured with respect to a helicopter for extraction from remote locations.

26. A rescue transportation device being capable of flotation which comprises:

(a) an inflatable support member including an inflation valve to facilitate inflation thereof, said support member being collapsible when not inflated to facilitate carrying thereof, said support member further including:

(1) a main section extending generally horizontally and being selectively inflatable, said main section defining a first support end and a second support end thereon; and (2) an inclined section in fluid flow communication with respect to said main section to be simultaneously inflatable therewith, said inclined section being adjacent to said first end of said main section and extending upwardly and outwardly therefrom;

(b) a cover means adapted to extend about said inflatable support member, said cover means defining a first cover end adjacent said first support end and a second cover end adjacent said second support end, said cover means including a removable access flap to facilitate access to said inflation valve, said cover means defining a slot means therein adapted to allow removal and replacement thereof in position extending about said inflatable support member, said cover means including a lower surface of double thickness extending across an entire lower surface of said main section and said inclined section, said cover means further including a triple reinforced section of a lower surface of said cover means adjacent the intersection between said inclined section and said main section;

(c) a head restraint means of open mesh material attachable with respect to said cover means and being adapted to receive and selectively restrain a user's head with respect to said inflatable support member, said head restraint means including:

(1) a first inflatable cushion means being manually inflatable;

(2) a second inflatable cushion means being manually inflatable and spatially disposed laterally from said first inflatable cushion means and adapted to receive a user's head therebetween for support and restraint thereof, said first and second inflatable cushion means being movably adjustable laterally to vary the spatial separation therebetween to facilitate usage of the rescue transportation device with variously sized heads of users and for use with user helmets; and (3) a head retaining strap means of open mesh material securable with respect to said first inflatable cushion and said second inflatable cushion to facilitate support and restraint of a user's head therebetween.

(d) a lower body restraint means attachable with respect to said cover means and being adapted to receive and selectively restrain a user's head with respect to said inflatable support member;

(e) a first restraint attachment means comprising a hook and loop type attachment device secured to said cover means adjacent said first cover end thereof and adapted to receive and selectively secure one of said head restraint means and said lower body restraint means with respect to said cover means adjacent said first cover end thereof;

(f) a second restraint attachment means comprising a hook and loop type attachment means secured to said cover means adjacent said second cover end thereof and adapted to receive and selectively secure one of said head restraint means and said lower body restraint means with respect to said cover means adjacent said second cover end thereof;

(g) a central body restraint means secured with respect to said cover means and adapted to restrain the central body area of a user with respect to said inflatable support member;

(h) gusset means secured to said cover means adjacent said inclined section and adjacent said main section to facilitate maintaining of said inclined section in a position extending upwardly and outwardly with respect to said main section and to provide protection to a user during dragging thereof;

(i) litter handle means secured along a pair of upper sides of said cover means to facilitate carrying of said inflatable support member;

(j) a blanket means selectively securable with respect to said cover means;

(k) a towing securement means fixedly mounted to said cover means and adapted to detachably secure a towing line therein to facilitate dragging of the rescue transportation device, said towing securement means further including:

(1) a first towing attachment means located adjacent to said first cover end to facilitate dragging of said inflatable support member with said inclined section extending forwardly;

(2) a second towing attachment means located adjacent to said second cover end to facilitate dragging of said inflatable support member with said inclined section extending rearwardly;

(l) a tow line means being selectively attachable with respect to said towing securement means to facilitate dragging of the rescue transportation device;

(m) an inflation means detachably securable with respect to said cover means for mounting thereof;

(n) an inflation attachment means fixedly secured with respect to said cover means and adapted to detachably secure said inflation means thereto; and (o) a one-way pneumatic inflation valve positioned in said inflatable support member to facilitate inflation thereof.

* * * * *